US008222503B2

(12) United States Patent
Aspri

(10) Patent No.: US 8,222,503 B2
(45) Date of Patent: Jul. 17, 2012

(54) SOUND REVERBERATOR DEVICE FOR DETACHABLE CONNECTION TO THE STRINGS OF A STRING MUSICAL INSTRUMENT

(76) Inventor: Roberto Aspri, Montréal (CA)

( * ) Notice: Subject to any disclaimer, the term of this patent is extended or adjusted under 35 U.S.C. 154(b) by 134 days.

(21) Appl. No.: 12/777,307

(22) Filed: May 11, 2010

(65) Prior Publication Data

US 2011/0277614 A1 Nov. 17, 2011

(51) Int. Cl.
*G10D 3/02* (2006.01)

(52) U.S. Cl. ..... 84/294

(58) Field of Classification Search ..... 84/294
See application file for complete search history.

(56) References Cited

U.S. PATENT DOCUMENTS

| | | | | | |
|---|---|---|---|---|---|
| 231,084 | A * | 8/1880 | Peake | 84/295 |
| 685,920 | A * | 11/1901 | Heck | 84/294 |
| 936,624 | A * | 10/1909 | Hale | 84/297 R |
| 1,513,159 | A * | 10/1924 | Cremer | 84/295 |
| 1,539,961 | A * | 6/1925 | Scott | 181/181 |
| 1,560,372 | A * | 11/1925 | Berge | 84/270 |
| 1,588,730 | A * | 6/1926 | Hessel | 84/294 |
| 4,762,046 | A * | 8/1988 | Aspri et al. | 84/294 |
| D314,968 | S * | 2/1991 | Aspri et al. | D17/20 |
| 5,567,895 | A * | 10/1996 | Aspri et al. | 84/294 |
| 5,581,043 | A * | 12/1996 | Bowar | 84/291 |
| 6,040,510 | A * | 3/2000 | Yaun | 84/294 |
| 6,646,191 | B1 * | 11/2003 | Martin | 84/291 |
| 7,855,330 | B2 * | 12/2010 | Lyles et al. | 84/297 R |
| 7,977,565 | B1 * | 7/2011 | Lye | 84/723 |
| 2010/0083806 | A1 * | 4/2010 | Peavey | 84/294 |
| 2011/0277614 | A1 * | 11/2011 | Aspri | 84/294 |

* cited by examiner

*Primary Examiner* — Elvin G Enad
*Assistant Examiner* — Robert W Horn
(74) *Attorney, Agent, or Firm* — Norton Rose Canada LLP

(57) ABSTRACT

A sound reverberator device for detachable connection to the strings of a string musical instrument which has strings tensioned over a bridge piece connected to the top wall of the sound box or the instrument. The reverberator comprises three spaced apart metal coil springs secured side-by-side at a common end to a spring support. A metallic string attachment member is secured to a free end of each of the springs. The attachment member has string engaging fingers for engaging a respective one of a pair of adjacent strings of the musical instrument. The attachment member further has a bridge abutment portion for contact with the bridge piece. When the reverberator is connected to the musical instrument, the springs are tensioned with the attachment member connected to the strings whereby vibrations imparted to the strings will be transmitted to the bridge piece and the associated spring. The spring will then vibrate and transmit its vibrations to the sound box through the bridge piece whereby to modify the tonality sound generated by the sound box. A sound damping device also provides progressive sound damping produced by the springs.

9 Claims, 6 Drawing Sheets

SOUND REVERBERATOR DEVICE FOR DETACHABLE CONNECTION TO THE STRINGS OF A STRING MUSICAL INSTRUMENT

TECHNICAL FIELD

The present invention relates to a sound reverberator device which is detachably securable to the strings of a string musical instrument whereby the vibrations imparted to the strings will be transmitted to springs contained in the device with the spring vibration being transmitted into the sound box of the musical instrument through the bridge piece whereby to enhance the sound generated by the sound box.

BACKGROUND ART

It is well known that in order to enhance the tonality of a sound box of a musical instrument, to incorporate within the sound box a large spring which can respond to the vibrations of the strings of the musical instrument to give maximum resonant effect and amplify and modify the tones generated by plucking, frictioning, stricking or otherwise vibrating the strings of the instrument.

It is known to secure large springs to a frame to suspend the springs vertically above the strings of the instrument over the top wall of the sound box and at a location, in front of the bridge piece. A loop at the free end of the springs connects directly to two strings and vibrates with the strings to enhance the sound of the instrument. The device can be easily removed or disconnected if the original sound of the musical instrument is required. However, this device has many disadvantages, in that it is unsightly, it does not provide good attachment of the springs to the strings, it is difficult to install, is cumbersome, and also it provides obstruction to the area of the instrument where the user must place his hand to pluck or otherwise activate the strings to vibrate them.

SUMMARY OF INVENTION

It is a feature of the present invention to provide an improved sound reverberator device.

Another feature of the present invention is to provide a sound reverberator device which is detachably connectable to the strings of a string instrument, which is not cumbersome, which is aesthetically pleasing, which is easy to install, and which greatly enhances the tonality of the sound emanating from the sound box of the instrument and wherein sound damping can be progressively adjusted.

According to the above feature, from a broad aspect, the present invention provides a sound reverberator device for detachable connection to the strings of a string musical instrument having strings tensioned over a bridge piece connected to a top wall of the sound box of the instrument. The reverberator comprises three spaced-apart metal coil springs secured side-by-side at a common end to a spring support. A metallic string attachment member is secured to a free end of each of the springs. The attachment member has string engaging means for engaging a respective one of a pair of adjacent strings of the musical instrument. The attachment member further has a bridge abutment portion for contact with the bridge piece. Means is provided to tension the springs with the attachment member connected to the strings whereby vibrations imparted to the strings will be transmitted to the bridge piece and associated spring. The spring being vibrated by the associated strings, transmits its vibration to the sound box through the bridge piece whereby to modify the tonality of the sound generated by the sound box. Variable sound damping means is displaceably supported from a non-sound damping position to a progressively sound damping position.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
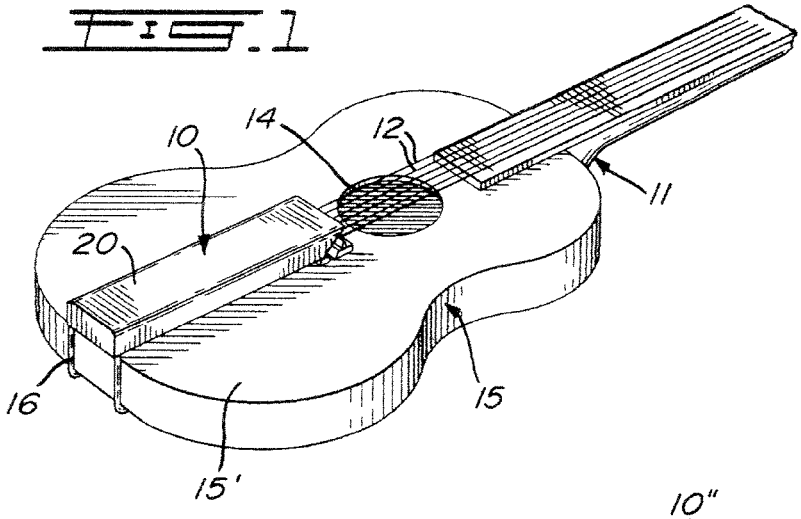
FIG. 1 is a perspective view of a string instrument to which is secured the sound reverberator device of the present invention.

Referring now to the drawings and more particularly to FIG. 1 there is shown generally at 10 the sound reverberator device of the present invention as secured to a string musical instrument, herein a classical guitar 11. As herein shown, the sound reverberator device 10 is connected to the strings 12 of the guitar and disposed rearwardly of the bridge piece 13 located rearwardly of the opening 14 of the sound box 15. The sound reverberator device 10 is secured to the strings 12, as will be described later and retained flat over the top wall 15' of the sound box by a clamp 16.

Referring now additionally to FIGS. 3 to 6, the sound reverberator of the present comprises essentially three, spaced-apart, metal coil springs 17 which are secured at a rear end 18 to a support, herein constituted by the rear wall 19 of the housing 20. A metallic string attachment member 21 is secured to a loop end 17' of the spring 17 at a forward end thereof and when not connected to the strings, abut against a front edge 23 of two dividing walls 22 disposed on each side of the center spring 17". The walls 22 isolate the springs from one another. The housing 20 protects and conceals the springs and is preferably constructed of a plastic material and as herein shown, consists of a top wall 24, opposed side walls 25 and bottom wall 26. The front end of the housing is opened for access to the springs and permit for the springs to be stretched. The springs 17 are normally tensioned between their front end and rear end connections although this is not essential as the tension can be adjusted by other means as will be described later.

Figure 6:
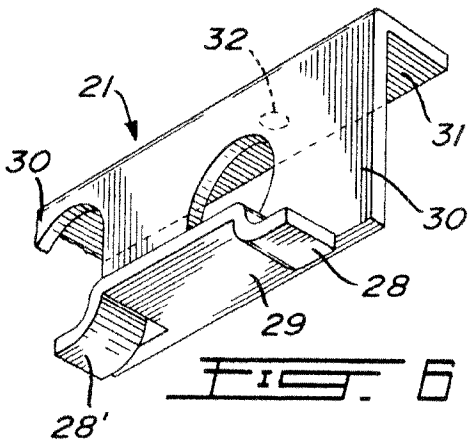
FIG. 6 is a enlarged fragmented view of one form of attachment ember.

The string attachment member 21, as more clearly shown in fragmented view in FIG. 6, is provided with a string engaging means in the form of two spaced-apart contact fingers 28 and 28' which are formed integrally at the free end of a bridge attachment portion 29. This bridge attachment portion 29 is a narrow rib dimensioned to fit between a pair of strings, in non-obstructing relationship thereto and projects from the bottom edge of a spring connecting wall or arm 30. This connecting arm 30 is connected and formed integral with a unitary spring connecting flange 31 provided with three spaced-apart holes 32 to which a respective one of the springs 17 is attached. Accordingly, there are three spring connecting arms 30 disposed side-by-side and depending from the spring connecting flange 31.

Figure 4:
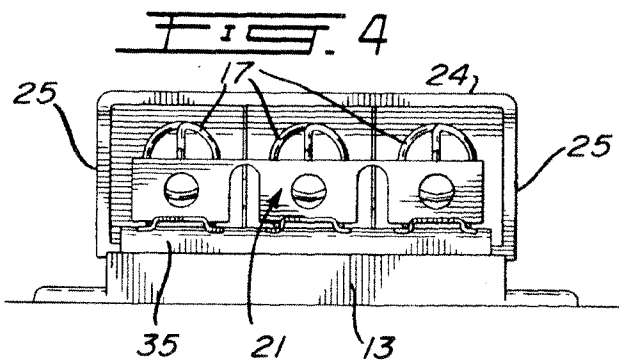
FIG. 4 is a front view of the sound reverberator device.

As seen more clearly in FIGS. 4 and 6, the fingers 28 and 28' depend downwardly from the bridge abutment portion and then are flared outwardly in opposed directions and in alignment with one another. When the sound reverberator device 10 is not in use, the spring connecting flange 31 is retained within a retention slot 23' formed within the front edge 23 of the dividing walls 22 and by the pulling force exerted by the tension in the spring 17.

Figure 2:
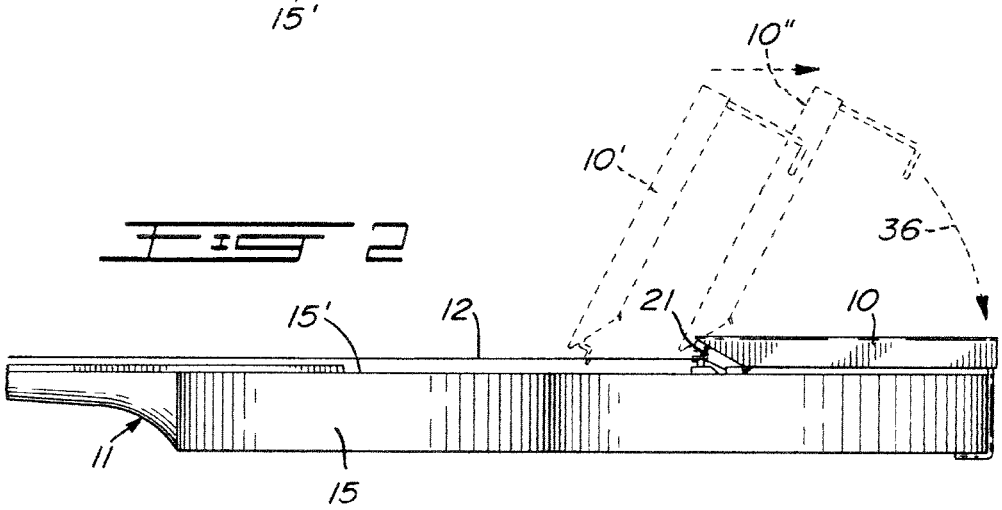
FIG. 2 is a side view of the sound instrument showing the manner in which the sound reverberator device of the present invention is installed.
Figure 3:
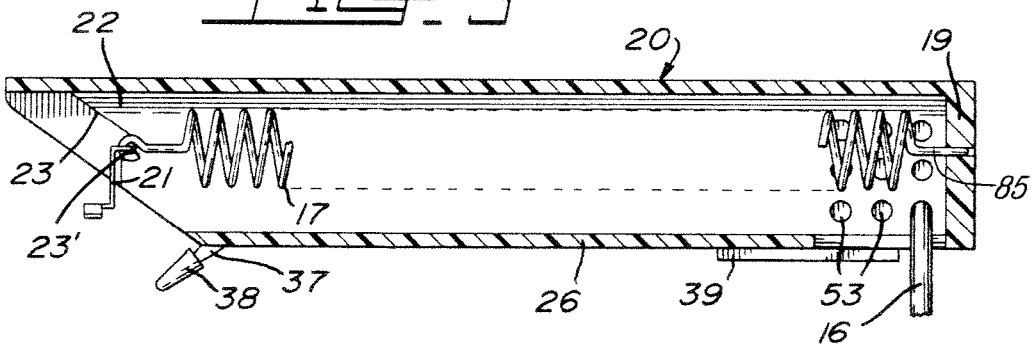
FIG. 3 is a elongated side section view of the sound reverberator device.
Figure 5:
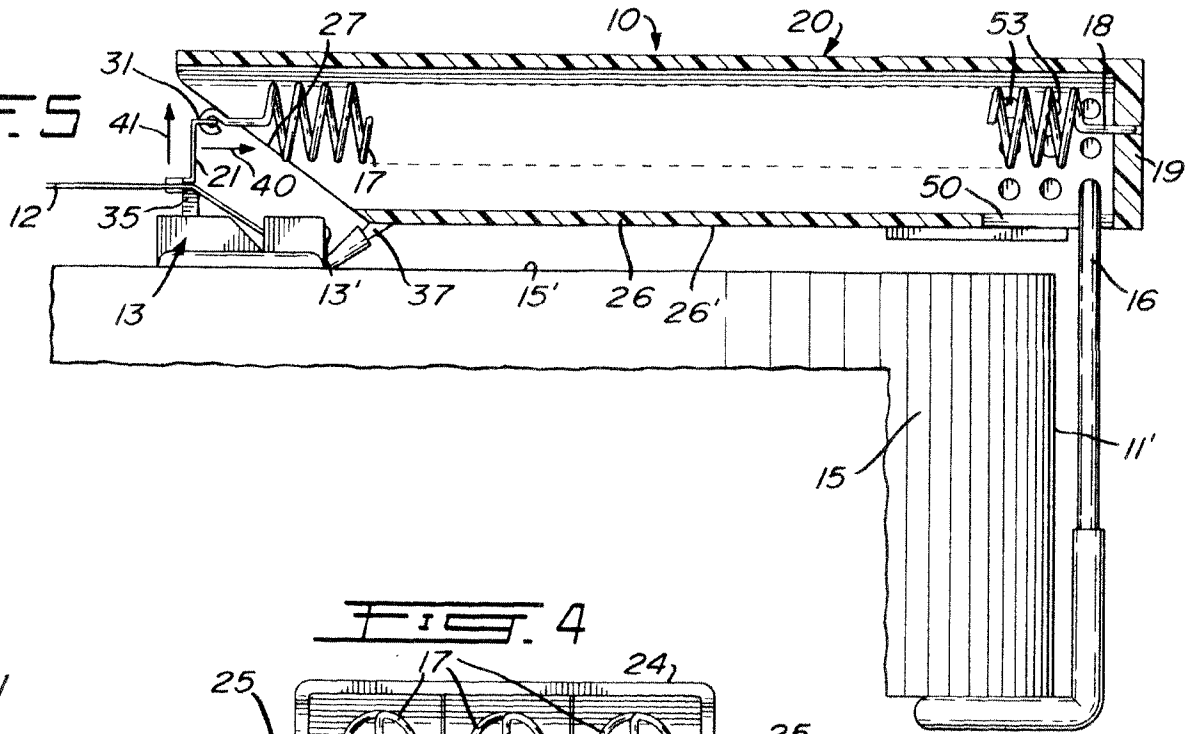
FIG. 5 is section of the sound reverberator device showing its installation on the top wall of the sound box of a musical instrument and its manner of attachment thereto.

Referring now more specifically to FIGS. 2, 4 and 5, there will be described the manner in which the sound reverberator device of the present invention is secured to the strings and the sound box of a string musical instrument such as the guitar 11. As shown in FIG. 2, the sound reverberator device is disposed substantially at the location as shown at 10' with the attachment member 21 extending diagonally over the strings whereby to position the contact finger 28 in the area between the strings. The housing 20 is then displaced to assume the position as shown at 10' with the bridge arm 29 extending between a respective pair 12' of the string 12 and the contact finger 28 located under a respective one of the strings of a pair 12'. The housing is then pulled back to the position as shown at 10" in FIG. 2 and until the bridge abutment portion 29 is located above the string support bridge 35 of the bridge piece 13. This support bridge 35 is usually made from ivory material which is a good vibration conducting material. In this position, the contact fingers are disposed immediately in front of the string support bridge 35. As can be seen in FIG. 5, a pair of legs 37 depends angularly frontwards from a front edge of a bottom wall 26 of the housing 20 to support the housing 20 elevated from the top wall 15' of the sound box 15. These legs 37 also act as a wedge against the bottom rear edge 13' of the bridge piece 13. A rubberized cover 38 is disposed over these legs at a free end thereof to prevent slippage of the housing. A rubber support pad 39 is also secured to the outer surface 26' of the bottom wall 26 to abut the top wall 15' of the sound box to also prevent slippage of the housing and maintains the housing elevated above the top wall 15' when the rear end portion of the housing 20 is disposed against this top wall 15'. This is not the case as shown in the installation of FIG. 5.

Figure 8:
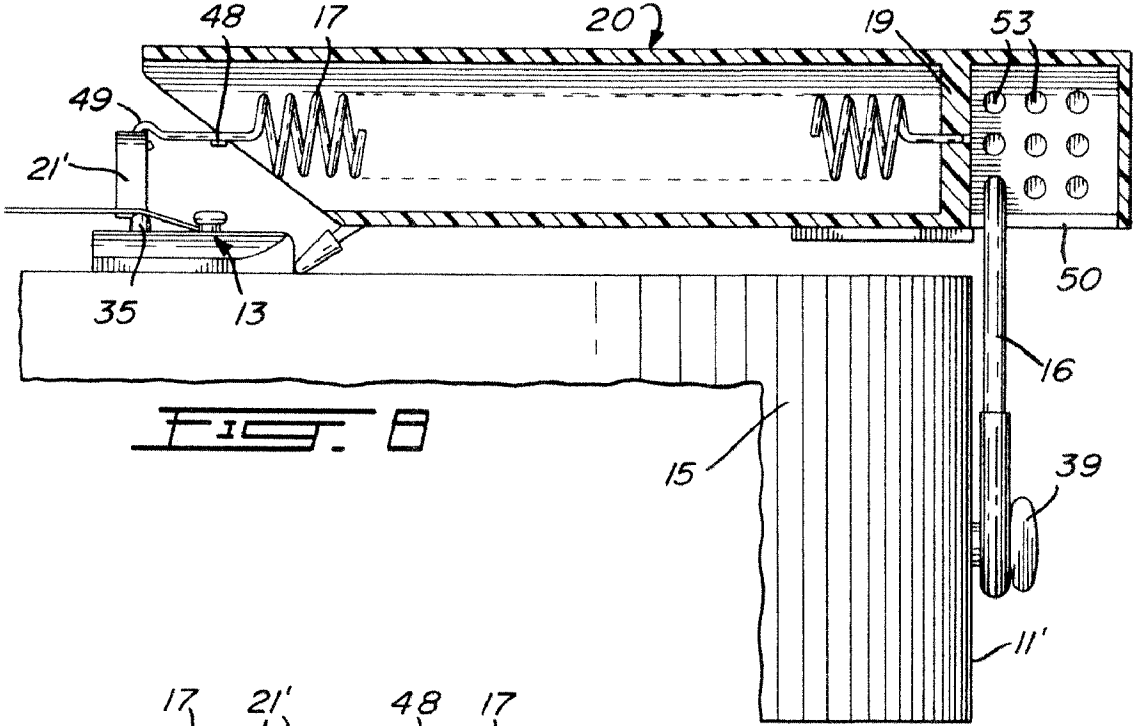
FIG. 8 is a fragmented side view of the sound box of a modified string musical instrument showing the sound reverberator device of the present invention as connected thereto by utilizing the attachment member of FIG. 7.

With the sound reverberator device 10 positioned at location 10", as shown in FIG. 2, the housing is then drawn rearwardly and downwardly in the direction of arrow 36 and this causes the springs 17 to be stretched to their position as shown in FIG. 5 freeing the spring connecting flange 31 from its engagement with the slots 23' formed in the front edge of the dividing walls 22. The clamp 16 is then engaged with the rear end wall 11' of the musical instrument by either positioning the flange portion 16' of the clamp under the bottom wall 11" of the housing or by attaching it to the knob 39 as secured the rear wall 11' of a western type guitar, as shown in FIG. 8. The clamp 16 as shown in FIG. 8 is of course shaped differently from that as shown in FIG. 2, but obvious to a person skilled in the art.

With the sound reverberator device 20 installed as shown in FIG. 5, the tension applied on the spring connecting flange 31, in the direction of arrow 40, imparts an upward force in the direction of arrow 41 onto the contact fingers 28 to provide good frictional contact with its associated strings 12. Thus, when a string 12 is plucked, it imparts a vibration which is transmitted to the sound box via the string support bridge 35 of the bridge piece 13 but this vibration is also transmitted to the spring 17 via the bridge abutment portion 29 and the spring connecting arm 30 and flange 31. The spring is thus set into vibration and this spring vibration is also transmitted back to the sound box 15 through the support bridge 35 and the bridge piece 13. This added vibration provides a resonant sound and amplify, give volume, prolong and further modify the tones usually generated by the vibrated string of the instrument.

Referring now to FIGS. 7 to 10, there is shown a modified version of the attachment member. As shown more clearly in FIG. 7, the attachment member, herein designated by reference numeral 21', is a generally u-shaped, narrow flat strip, member having opposed side arms 42 and 42' and a top intermediate integral top arm portion 43. A contact finger 44 is formed in a forward free edge portion of each of the side arms 42 and 42' by an outwardly extending integral flange which depends from the lower edge 45 to fit under the strings, as previously described with reference to contact fingers 28. The rear end edge 45 of each of the side arms 42 and 42' constitute the bridge abutment portion. The spring connecting arm is constituted by the side arms 42 and 42' and the top intermediate integral arm portion 43. This arm portion 43 is provided at its apex with a hole 46 centrally disposed therein for receiving a connecting loop end of an associated one of the springs 17.

Figure 9:
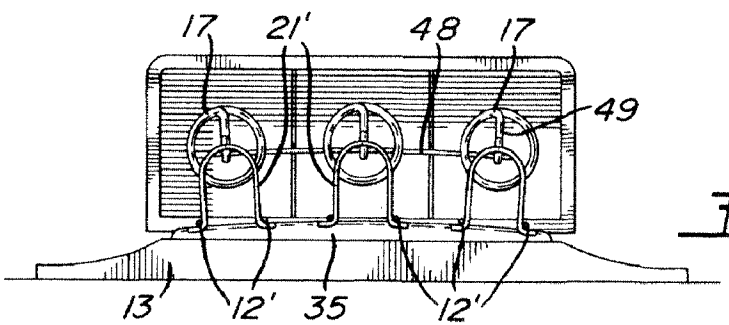
FIG. 9 is a front view of the sound reverberator device of FIG. 8 showing the attachment members secured to the strings of a western type guitar.
Figure 7:
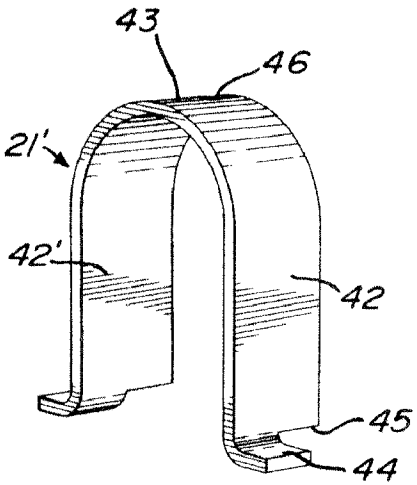
FIG. 7 is a perspective view of another form of the attachment member.
Figure 10:
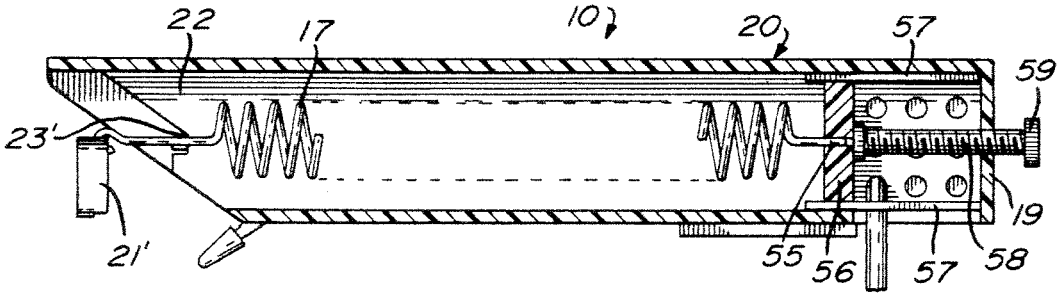
FIG. 10 is a elongated side section view of a modified sound reverberator device of the present invention.

As shown in FIGS. 8, 9 and 10, a connecting loop end of an associated one of the springs 17. As shown in FIGS. 8, 9 and 10, a connecting bar 48 is secured rearwardly of the loop ends 49 of the springs 17 to maintain the springs interconnected spaced-apart and to maintain the springs 17 under tension by locating the connecting bar 48 in the slots 23' of the dividing walls 22, as previously described with reference to FIGS. 3 to 5. The attachment members 21' are preferably for use with a western type guitar and it can be seen that these attachment members are individually connected to associated ones of the springs 17. They are secured to respective ones of pairs of strings 12' as more clearly shown in FIG. 9 and these are disposed over the string support bridge 35 of the bridge piece 13 in the manner as more clearly illustrated in FIG. 8.

Figure 11:
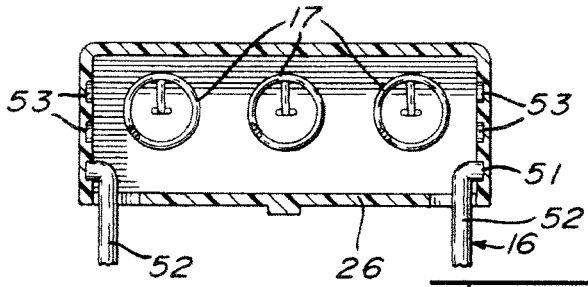
FIG. 11 is a partly fragmented end view showing the manner of adjustably securing the hinge clamp to the side walls of the housing.
Figure 12:
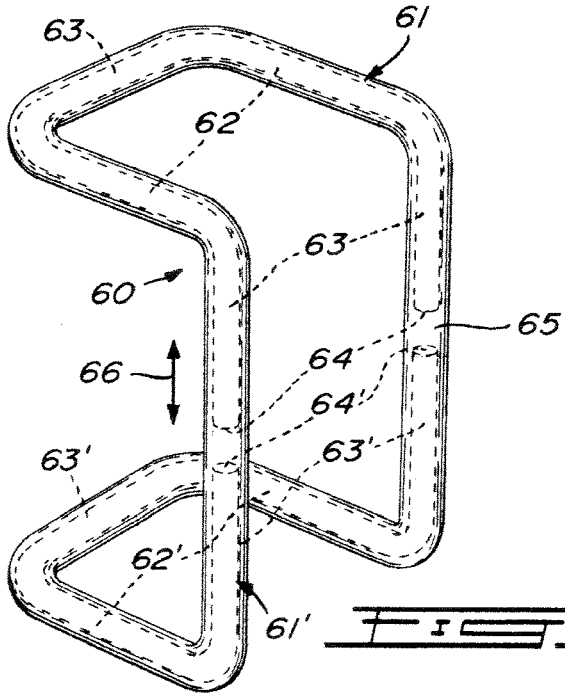
FIG. 12 is a perspective schematic view showing the construction of a further embodiment of a hinge clamp.

As shown more clearly in FIGS. 5 and 11, the bottom wall 26 of the housing 20 is provided with an opening in a respective rear corner thereof whereby to receive therein the pivoting end connection 51 of the clamping arm 52 of the clamp 16 for hingedly securing the hinge end 51 in a selected one of a plurality of cavities 53 formed in an inner surface of the side walls 25. This provides adjustment for the clamp 16 to fit musical instruments having sounding boxes of different thicknesses. Also these cavities permit longitudinal adjustment of the clamp to adapt to sound box 15 having different lengths from the rear edge 13' of the bridge piece 13 to the rear wall 11' of the sound box 15.

Referring now to FIG. 10, there is shown another modification of the sound reverberator device 10 in that the springs 17 are connected at their inner ends 55 to a displaceable connecting wall 56 which is guided in a transverse plane between opposed guide rails 57. This wall 56 is displaceable by a threaded bolt 58 extending through the rear wall 19 of the housing 20 and axially rotatable by a knob 59. By rotating the bolt 58, the position of the wall 56 is displaced and the tension on the spring 17 is also varied whereby to adjust the tonality of the sound. This knob 59 thus acts as a fine tuning adjustment to vary the tonality of the reverberation of the sound which is generated by the vibration in the springs 17.

Referring now to FIGS. 13A to 16, there will be described the construction operation of the variable sound damping means of the present invention. The sound damping means is comprised of a sound damping pad 70 which is displaceably supported spaced above the one or more metal springs 17 and displaceable against a biasing sloped ramp 71 to progressively push the damping pad 70 against the metal springs 17, as shown in FIG. 13B, whereby to produce a progressive damping sound when the strings 12 are vibrated, thereby transmitting vibration into the springs. The damping pad 70 is a suitable rubber pad which is immovably secured to a displaceable flat flexible wall member 72 formed of a plastic material or spring metal capable of having a memory to restore to its initial position when being flexed by displacement in the direction of arrow 73 and against the slope surface 74 of the ramp 71.

Figure 13A:
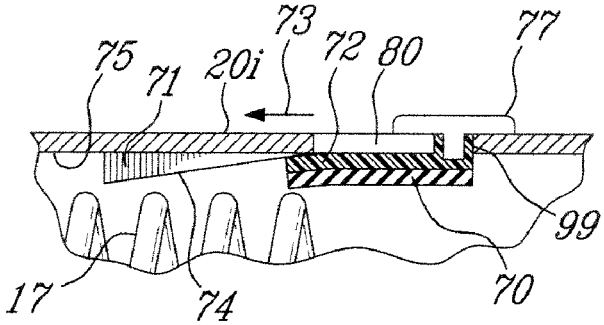
FIG. 13A is a fragmented section view showing the construction of a sound damping mechanism secured to the housing of the metal springs secured in the reverberator housing showing the damping means in a non-sound damping position.
Figure 13B:
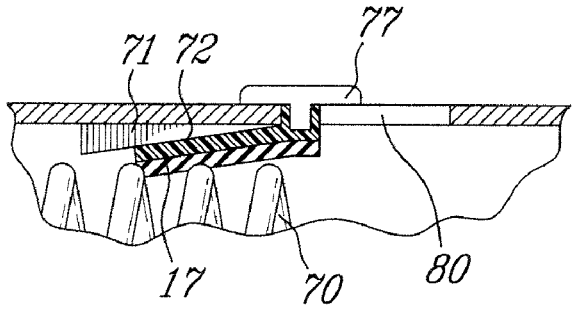
FIG. 13B is a view similar to FIG. 13A showing the sound damping mechanism in a maximum sound damping position.
Figure 14:
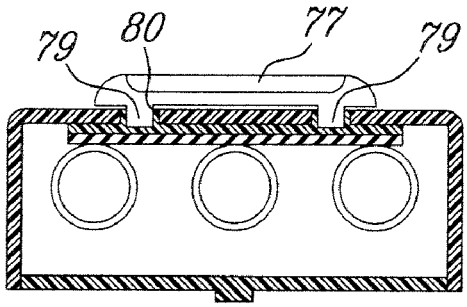
FIG. 14 is a cross-sectional end view showing the construction of the sound damping mechanism.
Figure 15:
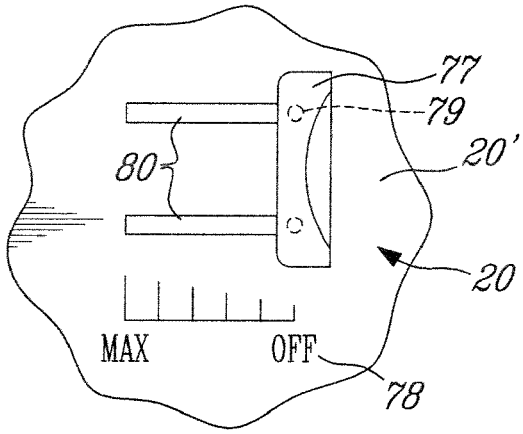
FIG. 15 is a fragmented top view showing the construction of the finger engaging slide member secured to the support of the sound damping pad and its displacement relative to guide slots provided in the top wall of the housing.
Figure 16:
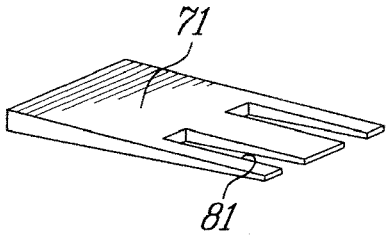
FIG. 16 is a perspective view of the ramp forming part of the sound damping mechanism.

The biasing slope ramp 71 is immovably secured to an inner wall 75 of the top wall 20' of the housing 20 by suitable means such as glue. The biasing slope ramp has its sloping surface 74 diminishing towards the rear end of the metal springs to a ramp entrance position 76. As can be seen, the displaceable flat flexible wall member 72 abuts over the ramp entrance 76 when at the non-damping position with its finger engaging slide member 77 positioned in the OFF position 78 as shown in FIG. 15. The finger engaging slide member 77 is connected to the flat flexible wall member 76 by post connections 79 as better seen in FIG. 14. There are two post connections 79 and they extend respectively through guide slots 80 formed in the top wall 20' of the housing 20 as shown in FIG. 15. The post connections snap-fit within holes provided in the body portion 99 of the wall member 72. As shown in FIG. 16, the ramp 71 is also provided with guide slots 81 which are positioned in alignment with the guide slots 80 and under the top wall 20' to permit passage of the post connections 79 while the flexible wall member flexes thereunder, as illustrated in FIG. 13B, to dampen the vibration of the spring 17.

Figure 17:
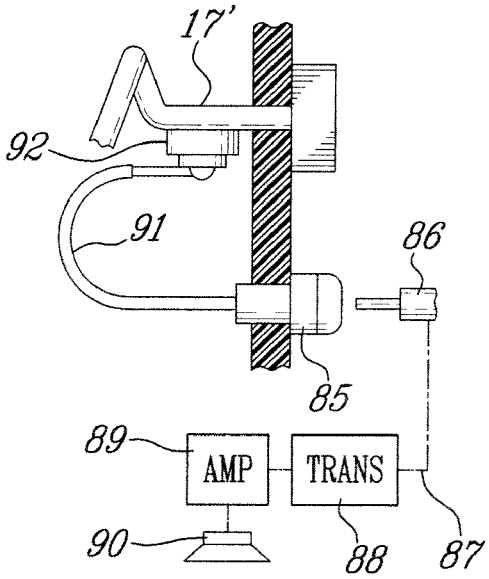
FIG. 17 is a fragmented side view showing the construction of a connecting jack secured to the springs and to a transducer and an amplifier for amplifying the sound of the springs in the sound reverberator of the present invention.

Referring now to FIG. 17, there is shown a female connecting jack 85 secured to the rear end wall 19 of the housing 20 for receiving a connective prong 86 having a lead connection 87 to a transducer 88 which feeds the sound from the vibrating springs to an amplifier 89 connected to speakers 90 to amplify the sound produced by the reverberator of the present invention. The female connecting jack 85 is secured by a wire 91 to a metal connecting bar 92 secured to the spring rear ends 17'.

Although, the reverberation device 10 as herein described is shown attached to a guitar, the device may also be used with other string instruments such as violins, mandolins, basses, etc.

It is within the ambit of the present invention to cover any other obvious modifications of the examples of the preferred embodiment described therein, provided such modifications fall within the scope of the appended claims.

I claim:

1. A sound reverberator device for detachable connection to the strings of a string musical instrument having strings tensioned over a bridge piece connected to a top wall of the sound box of said instrument, said reverberator comprising a housing open at a front end thereof, two or more metal springs disposed side-by-side in said housing and secured at a rear end to a spring support, a metallic attachment member secured to a free end of said spring, said attachment member has string engaging means for engaging a predetermined number of said strings in association with respective ones of said springs, said attachment member further having a bridge abutment portion for contact with said bridge piece, and means to tension said spring with said attachment member connected to said strings whereby vibrations imparted to said strings will be transmitted to said bridge piece and said associated spring; said spring being vibrated by said associated string and transmits its vibrations to said sound box through said bridge piece whereby to modify the tonality of the sound generated by said sound box as a result of setting the strings in vibration, and a sound damping pad displaceably supported from a non-sound damping position to a progressively sound damping position, said sound damping pad being spaced above said one or more metal springs and displaceable against a biasing sloped ramp to progressively push said damping pad against said metal springs to produce a progressive damping sound when said strings are vibrated to transmit vigration into said springs.

2. A sound reverberator device as claimed in claim 1 wherein said damping pad is a rubber pad immovably secured to a displaceable flat flexible wall member having a memory for restoring same to its initial shape when flexed by its displacement against said sloped ramp.

3. A sound reverberator device as claimed in claim 2 wherein said biasing sloped ramp is immovably secured to an inner wall of said top wall of said housing spaced above said springs, said biasing sloped ramp having a sloped surface diminishing towards said rear end of said metal springs to a ramp entrance, said displaceable flat flexible wall member abutting over said ramp entrance when at said non-damping position.

4. A sound reverberator device as claimed in claim 3 wherein said flat flexible wall member is secured to a finger engaging slide member connected thereto by post connections and displaceable over a top surface of said top wall of said housing, said post connections extending through guide slots in said top wall of said housing and said biasing sloped ramp.

5. A sound reverberator device as claimed in claim 4 wherein said attachment member is an integrally formed member, said string engaging means being constituted by two spaced-apart contact fingers disposable in pressure contact under a pair of associated strings when said reverberator device is secured in its position of use over said sound box.

6. A sound reverberator device as claimed in claim 5 wherein said attachment member is pivotally secured to said springs.

7. A sound reverberator device as claimed in claim 5 wherein said bridge abutment portion extends rearwardly of said contact fingers and is dimensioned to fit between a pair of said strings, and a spring connecting arm extending above said bridge abutment portion for connection to said springs.

8. A sound reverberator device as claimed in claim 7 wherein said string attachment member has a unitary spring connecting flange to which said springs are connected at an end in spaced relationship, there being three of said spring connecting arm formed integral with said flange and depending therefrom in a spaced-apart relationship, said bridge abutment portion being formed in a bottom edge of each said three connecting arms and extending forwardly thereof, said pair of contact fingers being formed integrally with each said bridge abutment portion adjacent a free end thereof, each finger of said pair of fingers extending on a respective one of opposed sides of said bridge abutment portion.

9. A sound reverberator device as claimed in claim 1, wherein there is further provided a female connecting jack secured to said rear end wall of said housing for receiving a conductive prong having lead connection of a transducer secured to an amplifier, said female connecting jack having an electrical connection to a metal connection to said rear end of all of said two or more metal springs to provide for an amplified sound transmission of said reverberator device.

* * * * *